US011396391B2

(12) United States Patent
Funcheira et al.

(10) Patent No.: US 11,396,391 B2
(45) Date of Patent: Jul. 26, 2022

(54) CABLE BUNDLE BINDER

(71) Applicants: Diego Funcheira, Seville (ES); Francisco Antonio Sanchez de Lillo, Seville (ES)

(72) Inventors: Diego Funcheira, Seville (ES); Francisco Antonio Sanchez de Lillo, Seville (ES)

(73) Assignee: Atamazos, S.L., Seville (ES)

( * ) Notice: Subject to any disclaimer, the term of this patent is extended or adjusted under 35 U.S.C. 154(b) by 173 days.

(21) Appl. No.: 16/495,625

(22) PCT Filed: Mar. 22, 2018

(86) PCT No.: PCT/ES2018/070218
§ 371 (c)(1),
(2) Date: Sep. 19, 2019

(87) PCT Pub. No.: WO2018/178446
PCT Pub. Date: Oct. 4, 2018

(65) Prior Publication Data

US 2020/0047929 A1 Feb. 13, 2020

(30) Foreign Application Priority Data

Mar. 30, 2017 (ES) ..... ES201700446

(51) Int. Cl.
*B65B 13/06* (2006.01)
*B65B 13/26* (2006.01)

(52) U.S. Cl.
CPC ..... *B65B 13/06* (2013.01); *B65B 13/26* (2013.01)

(58) Field of Classification Search
CPC ..... B65B 13/06; B65B 13/26; H01B 1/00; H01B 13/00
USPC ..... 53/399
See application file for complete search history.

(56) References Cited

U.S. PATENT DOCUMENTS

| | | | | |
|---|---|---|---|---|
| 876,573 | A | 1/1908 | Myers | |
| 3,057,648 | A | 12/1960 | Schwarze et al. | |
| 3,118,365 | A | 1/1964 | Rollo et al. | |
| 3,821,058 | A | 6/1974 | Miller | |
| 4,094,342 | A | 6/1978 | Nishikawa et al. | |
| 4,156,443 | A | 5/1979 | Nishikawa et al. | |
| 6,233,796 | B1 | 5/2001 | van Wassenhove et al. | |
| 2008/0282645 | A1 * | 11/2008 | Beardsall | B65B 7/02 53/138.7 |

(Continued)

FOREIGN PATENT DOCUMENTS

| | | |
|---|---|---|
| EP | 3088768 A2 | 2/2016 |
| FR | 2627455 A1 | 8/1989 |

(Continued)

*Primary Examiner* — Chelsea E Stinson
(74) *Attorney, Agent, or Firm* — The Webb Law Firm

(57) ABSTRACT

Disclosed is an automated module for binding a cable bundle, including eight parts arranged in two halves and having an opening or closing movement around a cable bundle, a lacing tape being pushed between the parts, once the automated module is closed, to form around the cable bundle a first knot or clove hitch followed by a second safety knot as a double knot on the former, before exiting the automated module, followed by a guide releasing movement, tightening the respective knots in the listed order, cutting the ends of the lacing tape and opening the automated module to remove the cable bundle.

5 Claims, 12 Drawing Sheets

(56) References Cited

U.S. PATENT DOCUMENTS

2015/0267844 A1 9/2015 Zantout et al.

FOREIGN PATENT DOCUMENTS

| | | | | |
|---|---|---|---|---|
| JP | 52110193 | A | * | 9/1977 |
| WO | WO-9811564 | A1 | | 3/1998 |
| WO | WO-2012051114 | A1 | | 4/2012 |

* cited by examiner

CABLE BUNDLE BINDER

CROSS-REFERENCE TO RELATED APPLICATIONS

This application is the United States national phase of International Application No. PCT/ES2018/070218 filed Mar. 22, 2018, and claims priority to Spanish Patent Application No. P201700446 filed Mar. 30, 2017, the disclosures of which are hereby incorporated by reference in their entirety.

BACKGROUND OF THE INVENTION

Field of the Invention

The present disclosures related to equipment that automatically crimps or interconnects an assembly of cables. More particularly, systems contemplated herein are generally for application in the aeronautical, aerospace, naval, defense, and telecommunications sectors.

Description of Related Art

Taking into account the state of the art in the subject matter, a completely manual process is common in the aeronautical sector which is usually called "bundle binding" and which is basically performed by a set of operators distributed around tables whereon each assembly of cables to be joined extends, in order for the operator to be able to manually carry out the binding of the cable assembly or cable bundle every certain distance, using lacing tape in order to facilitate the subsequent installation of the cable bundle inside the chassis of the aircraft, the maintenance thereof and deterioration of each cable bundle being lesser compared to what would occur if the cabling was carried out without prior binding or doing it individually.

In further consideration of the state of the art in order to facilitate the understanding of the present invention, in short, it attempts to make a binding knot around the cable bundle, consisting of the combination of two individual knots on the same lacing tape, a first clove-hitch type binding knot followed by a second safety knot as a double knot, or double overhand knot/square knot.

The described prior art for creating these knots has the following drawbacks;

Heterogeneous quality levels and execution times.

Heterogeneous pressures of each knot.

Operators being at the risk of common injuries to their two little fingers.

According to the most similar tools present on the market, there are wire binders for the construction or agricultural sector, without any relation to the operation or application thereof with the present invention, according to the list of inventions provided below and identified by their publication number;

1. WO2012051114A1
2. U.S. Pat. No. 3,821,058 A
3. US 20150267844 A1
4. U.S. Pat. No. 3,118,365 A
5. WO 2012051114 A1
6. U.S. Pat. No. 6,233,796 B1
7. EP 3088768 A2
8. WO 1998011564 A1

SUMMARY OF THE INVENTION

The automated module for binding a cable bundle, described herein, provides the following advantages with respect to the state of the art;

1. Making knots in a fully automated manner by incorporating an automated electronic management system which adapts to the different types of bundles present on the market.
2. Standardized execution times.
3. Controllable and adjustable knot pressure.
4. From the point of view of preventing occupational hazards, the risk of the operator injuring their fingers when executing the knot is eliminated.
5. Adaptation of use, both as a gun-type hand-held tool or as automated tools such as a numerical control table or workbench.

An automated module for binding a cable bundle may include a definition of guides according to eight parts arranged in two halves around the vertical plane of longitudinal symmetry of a cable bundle, a lacing tape being pushed between the parts to form around the cable bundle a first knot or clove hitch followed by a second safety knot such as a double knot or double overhand/square knot on the former, before exiting the lacing tape of the assembly, which is when a first relative movement is carried out between the parts making up the guides in order to release the lacing tape, which make it possible to consecutively carry out the tightening of the respective knots, the first one or clove hitch around the bundle while the safety knot or double knot is performed on the former, while a second clam-like opening movement of the guide parts releases the bundle with corresponding knots already tightened thereon, with the ends already being cut beforehand, based on the combination of the following elements;

Four solid elements which wrap around the cable bundle and make up the clove hitch A. a first half of a main body designed to longitudinally wrap around a cable bundle;

B. a second half of the main body designed to longitudinally wrap around the cable bundle, joined to the previous part by a longitudinal shaft for opening the assembly and removing the cable bundle from above, C. a half of a guide body for lacing tape which traces an outline of the cable bundle acting as an inner wrapping of the first half of the main body, provided with movement longitudinal to the cable bundle itself;

D. a second half of the guide body for lacing tape which traces the outline of the cable bundle acting as an inner wrapping of the second half of the main body, provided with movement longitudinal to the cable bundle itself.

An automated module for binding a cable bundle may include a definition of guides according to eight parts arranged in two halves around the vertical plane of longitudinal symmetry of a cable bundle, a lacing tape being pushed between the parts to form around the cable bundle a first knot or clove hitch followed by a second safety knot such as a double knot or double overhand/square knot on the former, before exiting the lacing tape of the assembly, which is when a first relative movement is carried out between the parts making up the guides in order to release the lacing tape, which make it possible to consecutively carry out the tightening of the respective knots, the first one or clove hitch around the bundle while the safety knot or double knot is performed on the former, while a second clam-like opening movement of the guide parts releases the bundle with corresponding knots already tightened thereon, with the ends already being cut beforehand, based on the combination of the following elements;

Four solid elements which wrap around the cable bundle and make up the clove hitch A. a first half of a main body designed to longitudinally wrap around a cable bundle;

B. a second half of the main body designed to longitudinally wrap around the cable bundle, joined to the previous part by a longitudinal shaft for opening the assembly and removing the cable bundle from above, C. a half of a guide body for lacing tape which traces an outline of the cable bundle acting as an inner wrapping of the first half of the main body, provided with movement longitudinal to the cable bundle itself;

D. a second half of the guide body for lacing tape which traces the outline of the cable bundle acting as an inner wrapping of the second half of the main body, provided with movement longitudinal to the cable bundle itself.

Four solid elements which stay above the cable bundle, superimposed on the previous four which make up the double knot although they are provided with longitudinal movement with respect to the four previous solid elements, in order to facilitate the tightening of the double knot through the gap created in the central plane.

E. a first half of a guide for a first introduction of the lacing tape and a second return thereof;

F. a second half of the guide for the first introduction of the lacing tape and the second return thereof, provided with a movement channel to the central plane;

G. a first half of the part making up the half of the guide for the first return of the lacing tape and the final exit thereof;

H. a second half of the part making up the half of the guide for the first return of the lacing tape and the final exit thereof, provided with a movement channel to the central plane.

The system may include corresponding motorized rollers, presence sensors, cutting blades for terminating knots, reels holders for lacing tape, as well as a corresponding electronic system designed to manage the operation of the assembly in an automated manner with the possibility of adjusting the force that is required in the binding.

From the elements described, the operation thereof is carried out based on the following sequence;

1. Loading the assembly with the lacing tape making use of the reel holder.
2. Clam-like opening of the assembly of the eight solid elements making up the guide in two halves in order to introduce the cable bundle inside of it.
3. Closing the previous assembly once it contains the cable bundle.
4. Complete penetration of the lacing tape from the end thereof, forming the consecutive path of the two knots described, the clove hitch around the cable bundle which is started once the lacing tape returns to the assembly through the face opposite from the one by which it makes the first access, followed by a safety knot over the former, which is started after making a first return on the face for accessing the assembly and definitively exits the assembly through the face opposite from the first entry.
5. Once the lacing tape has formed the complete path associated with the corresponding knots, guide body for lacing tape which traces an outline of the cable bundle is removed, according to longitudinal movement of the guide body in the direction of the cable bundle.
6. Simultaneously to the previous step, a relative opening movement is carried out which is also longitudinal to the cable bundle associated with four solid elements which stay above the cable bundle, in order for there to be a central channel which enables the relative opening movement, as the lacing tape is subsequently pulled upon forming the safety knot, to be able to exit the guides thereof, making use of that central channel.
7. Tightening the clove hitch knot keeping the assembly in the closed position, making use of the corresponding motors turning in the direction wherein the aforementioned knot is tightened once the lacing tape does not find the guide bodies for lacing tape as it passes, and the knot is tensed around the cable bundle at the desired tension.
8. Tightening the double knot keeping the assembly in the closed position, once the previous knot is tensed, the double safety knot which stays above the previous one is then tensed by rotating the corresponding motors in the direction wherein they pull and, therefore, tighten the corresponding lacing tape in a controlled manner, causing it to exit in the two exits thereof from the assembly, from the guides thereof moved with respect to the central plane in order to be located over it wherein they have freedom of movement to carry out the tensing thereof around the previously-tightened clove hitch knot.
9. Cutting the lacing tape at both ends at a certain distance.
10. Opening the eight solid elements making up the guide in order to remove the cable bundle from the tied position thereof.

BRIEF DESCRIPTION OF THE DRAWINGS

To complement the description provided herein and for the purpose of helping to better understand the features of the invention according to a preferred practical embodiment thereof, said description is accompanied by a set of figures constituting an integral part of the same, wherein the following is depicted with an illustrative and non-limiting character.

Figure 1:
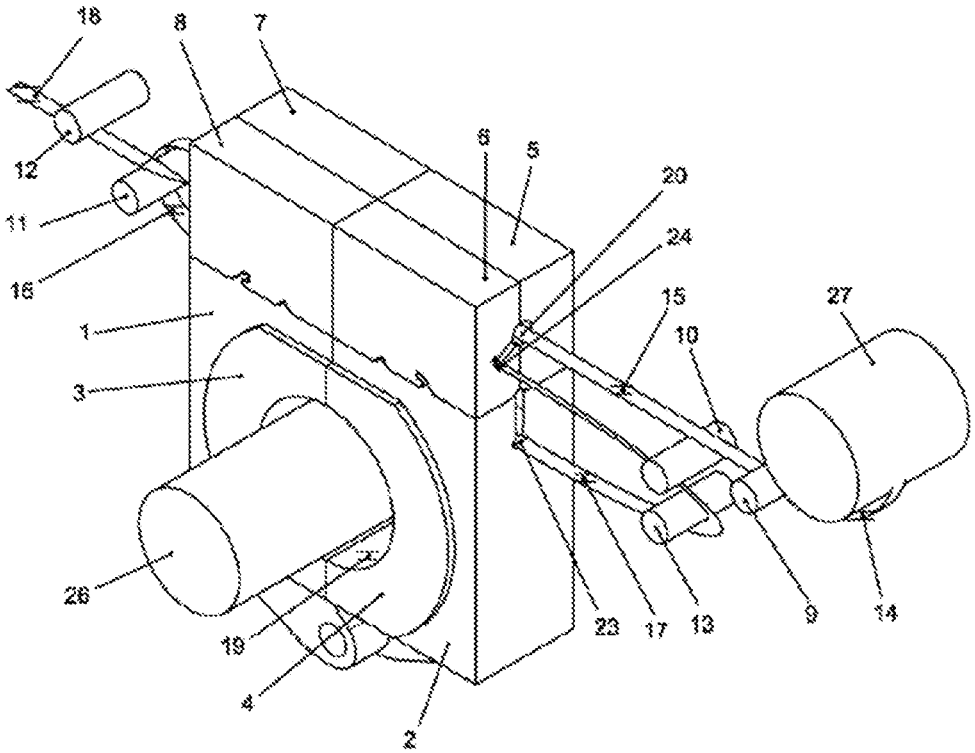
FIG. 1.—Main perspective view of the "Automated module for binding a cable bundle" with a cable bundle inside of it.
Figure 2:
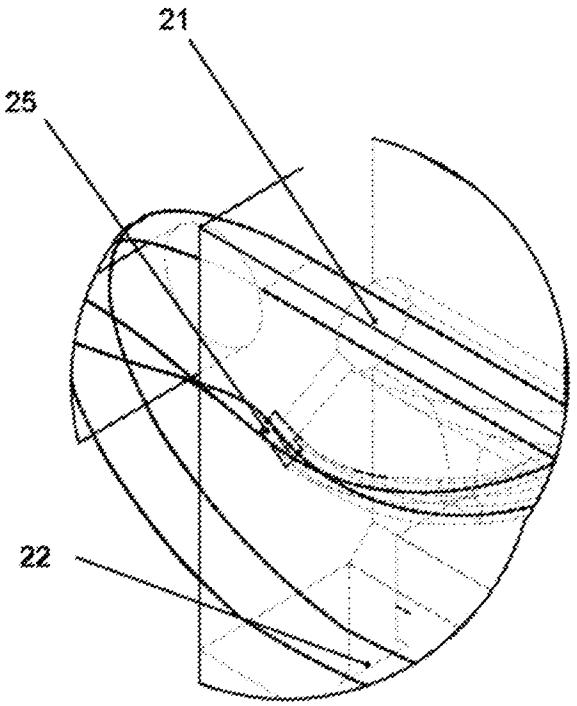
FIG. 2.—Main perspective view of the detail of the first exit and return of the lacing tape as well as the final exit of the "Automated module for binding a cable bundle".
Figure 3:
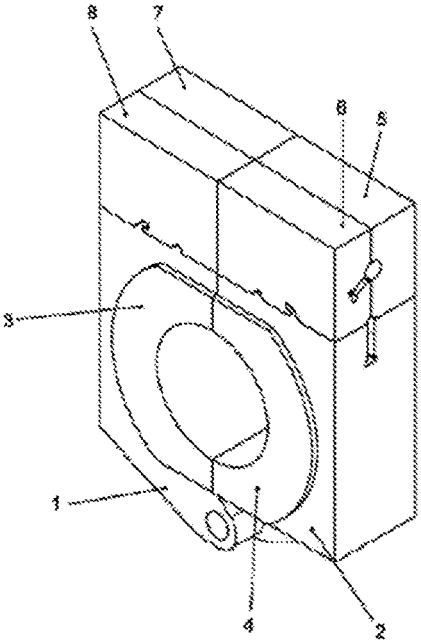
FIG. 3.—Main perspective view of the eight guide parts making up the "Automated module for binding a cable bundle" in the closed position.
Figure 4:
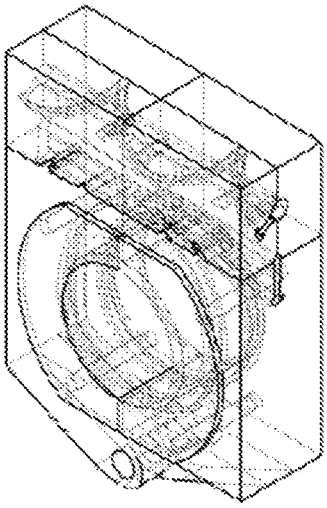
FIG. 4.—Main perspective view of the eight guide parts making up the "Automated module for binding a cable bundle" in the closed position with dotted line indicating hidden lines in order to show the guide path and relative movements between the aforementioned eight parts.
Figure 5:
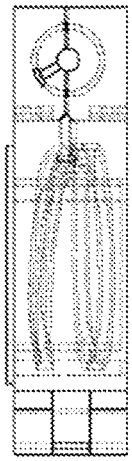
FIG. 5.—Main elevation view of the eight guide parts making up the "Automated module for binding a cable bundle" in the closed position with dotted line indicating hidden lines in order to show the guide path and relative movements between the aforementioned eight parts.

In the aforementioned figures the following constituting elements are highlighted;

1. Rear half of the main body which wraps around the cable bundle.
2. Front half of the main body which wraps around the cable bundle.
3. Rear half of the guide body for lacing tape which traces the outline of the cable bundle provided with movement longitudinal to the cable bundle itself.
4. Front half of the guide body for lacing tape which traces the outline of the cable bundle provided with movement longitudinal to the cable bundle itself.
5. Part making up the rear half of the guide for the introduction of the lacing tape and the return thereof.
6. Part making up the front half of the guide for introducing the lacing tape and the return thereof provided with a movement channel to the central plane.
7. Part making up the rear half of the guide for the introduction of the lacing tape wherein it makes the first return and the definitive exit from the assembly.
8. Part making up the front half of the guide for the introduction of the lacing tape wherein it makes the first return and the definitive exit from the assembly, provided with a movement channel to the central plane.
9. Electric stepping motor which removes the lacing tape from the reel holder.
10. Electric stepping motor to push the first entry of the lacing tape towards the guide body.
11. Electric stepping motor to push the first exit of the lacing tape and the return towards the inside.
12. Electric stepping motor to pull the last exit of the lacing tape.
13. Electric stepping motor to push the second exit of the lacing tape and the return towards the inside.
14. Presence sensor in the reel holder for loading the binding cable or making it available.
15. Presence sensor for the lacing tape in the access thereof to the assembly.
16. Presence sensor for the binding cable in the first exit from the assembly and the return thereto.

17. Presence sensor for the binding cable in the second exit from the assembly and return thereto.
18. Presence sensor for the binding cable in the definitive exit from the assembly.
19. Presence sensor for the cable bundle located on the base wherein it is housed.
20. Hole for the first access of the guide for lacing tape on the inside of the assembly.
21. Hole for the first exit of the lacing tape through the inside of the assembly.
22. Hole for the second access of the lacing tape through the inside of the assembly for being directed to the cable bundle of which it traces the outline, forming a clove hitch knot.
23. Hole for the exit of the lacing tape once the clove hitch has been concluded and before starting the double knot.
24. Hole for the entry of the lacing tape to form the double knot.
25. Hole for the final exit of the lacing tape once it has formed the complete path of the double knot.
26. Cable bundle to be bound.
27. Reel for supplying lacing tape.

In an embodiment of the "Automated module binding a cable bundle", in light of FIGS. 1-35 it can be obtained based on the composition of eight main parts 1-8, designed to embrace a cable bundle 26 on the inside thereof according to an arrangement of the eight parts 1-8 in two halves provided with opening movement around a shaft parallel to the direction of the cable bundle 26 and close to the base of the assembly, which in the closed position and conveniently articulating on the lacing tape, the entry and exit movements of the assembly making use of the corresponding binding reel 27, stepper motors 9-13 and presence sensors 14-19 make the aforementioned lacing tape form a path through the inside of the eight main parts 1-8, making a clove hitch-type binding knot on the cable bundle 26, which is followed by a second safety knot such as a double knot or double overhand knot/square knot on the former.

To facilitate the understanding of the example, FIGS. 6-15 show the four guide parts which wrap around the cable bundle 26, which are responsible for the lacing tape forming a clove hitch knot as it passes, being the rear and front halves of the main body which wrap around the cable bundle 1-2, as well as the rear and front halves of the guide body for lacing tape which traces the outline of the cable bundle 3-4 provided with releasing movement longitudinal to the cable bundle itself.

FIGS. 16-33 show the four parts 5-8 which stay above the cable bundle 26, which are responsible for the lacing tape forming a safety knot such as a double knot as it passes, they are the part making up the half of the guide for the first introduction of the lacing tape and the return thereof 5, part which makes up the other half of the guide for the introduction of the lacing tape and the return thereof provided with a movement channel to the central plane 6, part which makes up the half of the guide for the return of the lacing tape and the exit thereof 7, part which makes up the other half of the guide for the return of the lacing tape and the exit thereof, provided with a movement channel to the central plane 8.

Starting from the elements described, the operation of binding cable bundles is carried out by deploying the following sequence;

Phase A—Loading the system with the lacing tape.

Figure 6:
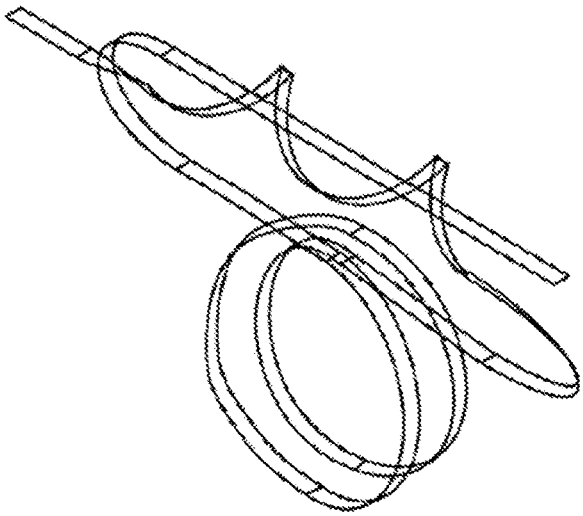
FIG. 6.—Main perspective view of the path formed by the lacing tape through the inside of the "Automated module for binding a cable bundle" without the aforementioned guide parts.
Figure 7:
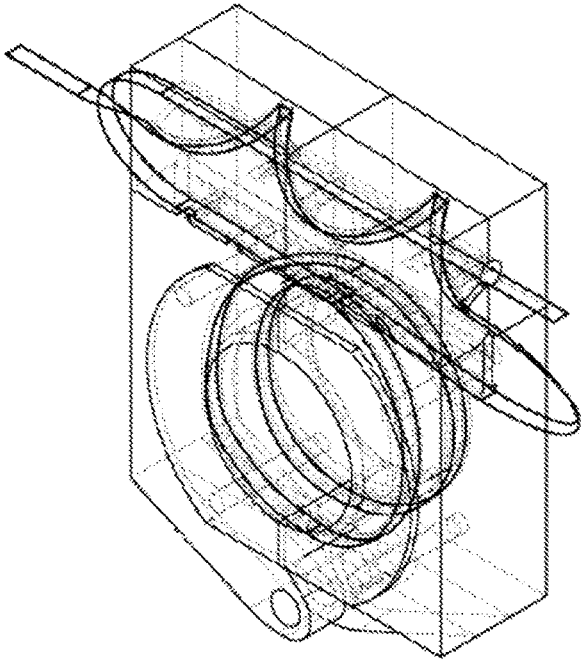
FIG. 7.—Main perspective view of the path described by the lacing tape through the inside of the "Automated module for binding a cable bundle".
Figure 8:
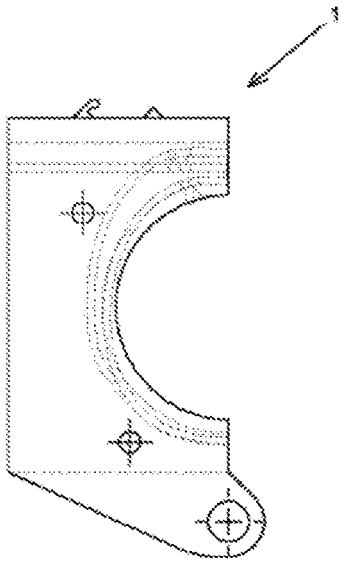
FIG. 8.—Elevation view of the 1st half of the main body which wraps around the cable bundle, leaving the cable bundle on the right, as shown.
Figure 9:
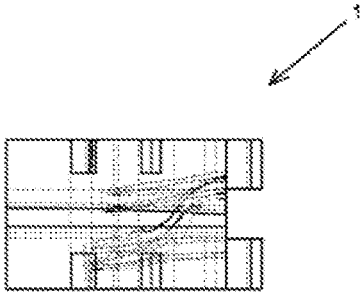
FIG. 9.—Plan view of the 1st half of the main body which wraps around the cable bundle, leaving the cable bundle on the right, as shown.
Figure 10:
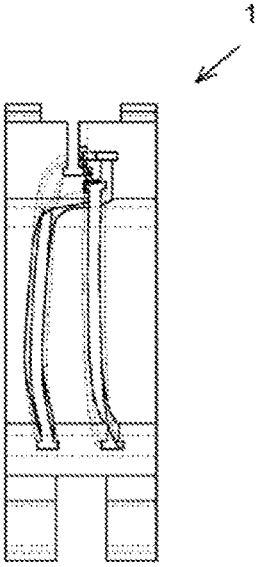
FIG. 10.—Profile view of the 1st half of the main body which wraps around the cable bundle, leaving the cable bundle on the right, as shown.
Figure 11:
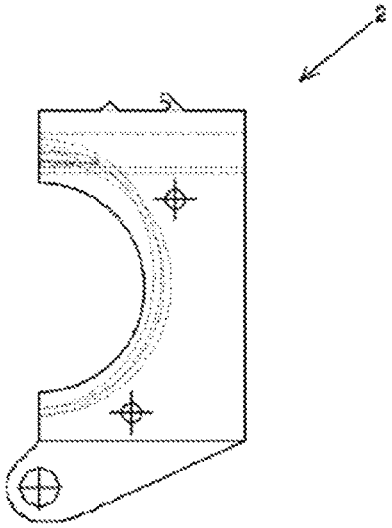
FIG. 11.—Elevation view of the 2nd half of the main body which wraps around the cable bundle, leaving the cable bundle on the left, as shown.
Figure 12:
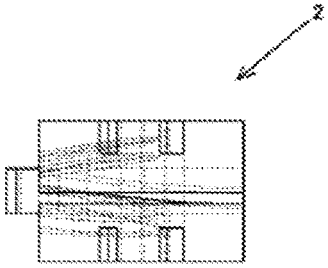
FIG. 12.—Plan view of the 2nd half of the main body which wraps around the cable bundle, leaving the cable bundle on the left, as shown.
Figure 13:
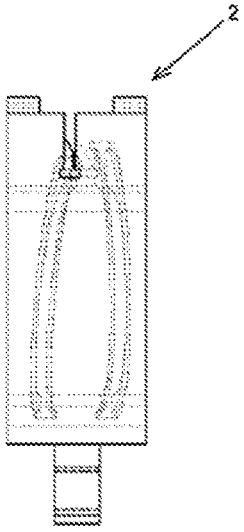
FIG. 13.—Profile view of the 2nd half of the main body which wraps around the cable bundle, leaving the cable bundle on the left, as shown.
Figure 14:
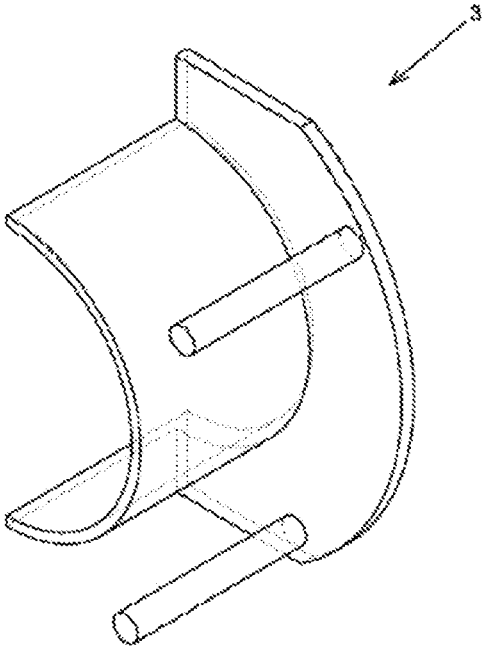
FIG. 14.—Main perspective view of the rear half of the guide body for lacing tape which traces the outline of the cable bundle provided with movement longitudinal to the cable bundle itself.
Figure 15:
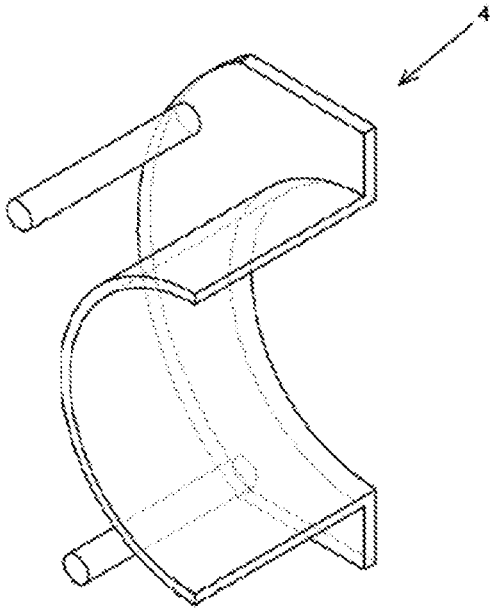
FIG. 15.—Main perspective view of the front half of the guide body for lacing tape which traces the outline of the cable bundle provided with movement longitudinal to the cable bundle itself.
Figure 16:
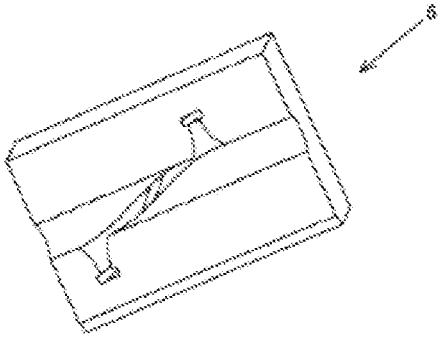
FIG. 16.—Inner perspective view of the part making up the half of the guide for the introduction of the lacing tape and the return thereof.
Figure 17:
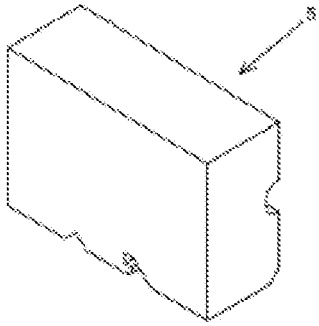
FIG. 17.—Outer perspective view of the part making up the half of the guide for the introduction of the lacing tape and the return thereof.
Figure 18:
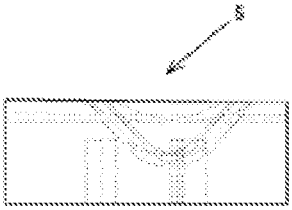
FIG. 18.—Plan view of the part making up the half of the guide for the introduction of the lacing tape and the return thereof.
Figure 19:
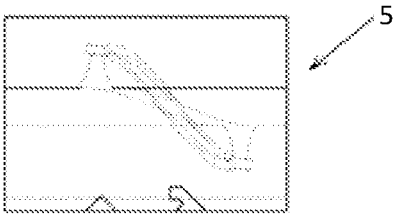
FIG. 19.—Elevation view of the part making up the half of the guide for the introduction of the lacing tape and the return thereof.
Figure 20:
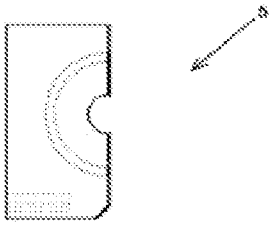
FIG. 20.—Profile view of the part making up the half of the guide for the introduction of the lacing tape and the return thereof.
Figure 21:
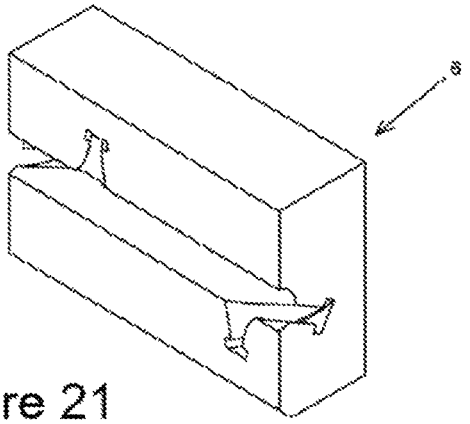
FIG. 21.—Inner perspective view of the part making up the other half of the guide for the introduction of the lacing tape and the return thereof provided with a movement channel to the central plane.
Figure 22:
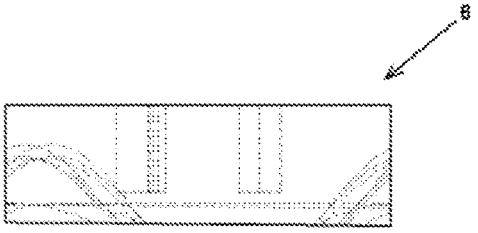
FIG. 22.—Plan view of the part making up the other half of the guide for the introduction of the lacing tape and the return thereof provided with a movement channel to the central plane.
Figure 23:
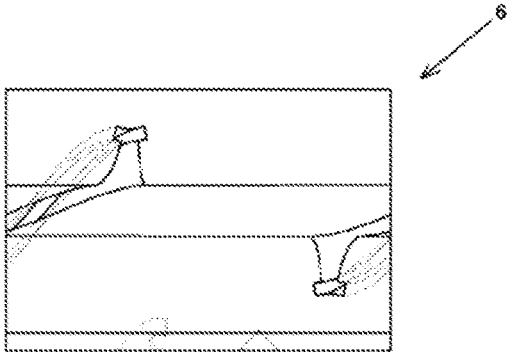
FIG. 23.—Elevation view of the part making up the other half of the guide for the introduction of the lacing tape and the return thereof provided with a movement channel to the central plane.
Figure 24:
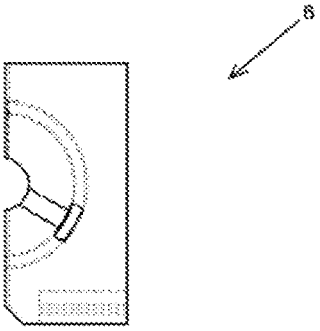
FIG. 24.—Profile view of the part making up the other half of the guide for the introduction of the lacing tape and the return thereof provided with a movement channel to the central plane.
Figure 25:
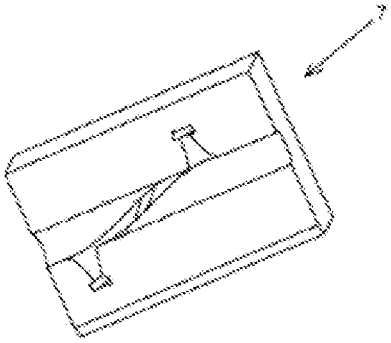
FIG. 25.—Inner perspective view of the part making up the half of the guide for the return of the lacing tape and the exit thereof.
Figure 26:
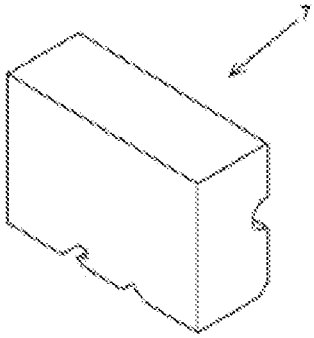
FIG. 26.—Outer perspective view of the part making up the half of the guide for the return of the lacing tape and the exit thereof.
Figure 27:
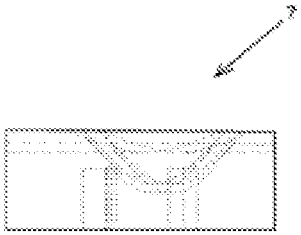
FIG. 27.—Plan view of the part making up the half of the guide for the return of the lacing tape and the exit thereof.
Figure 28:
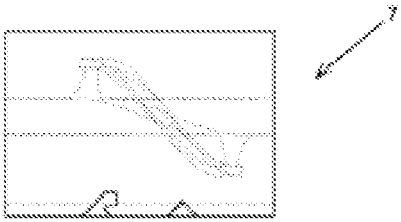
FIG. 28.—Elevation view of the part making up the half of the guide for the return of the lacing tape and the exit thereof.
Figure 29:
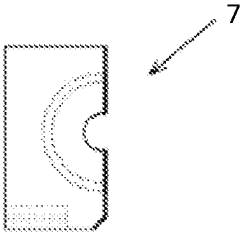
FIG. 29.—Profile view of the part making up the half of the guide for the return of the lacing tape and the exit thereof.
Figure 30:
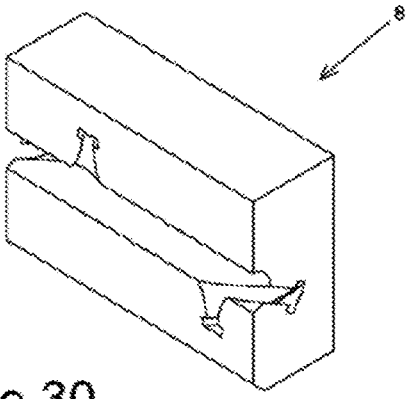
FIG. 30.—Inner perspective view of the part making up the other half of the guide for the return of the lacing tape and the exit thereof, provided with a movement channel to the central plane.
Figure 31:
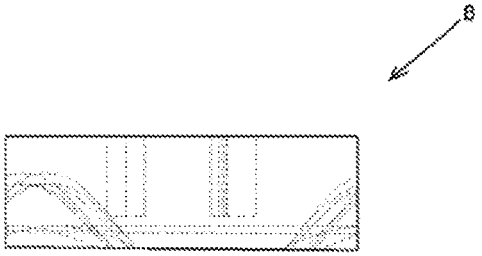
FIG. 31.—Plan view of the part making up the half of the guide for the return of the lacing tape and the exit thereof, provided with a movement channel to the central plane.
Figure 32:
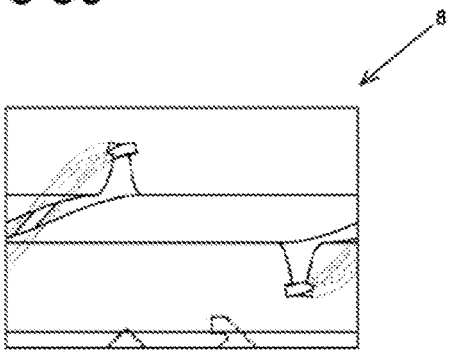
FIG. 32.—Elevation view of the part making up the other half of the guide for the return of the lacing tape and the exit thereof, provided with a movement channel to the central plane.
Figure 33:
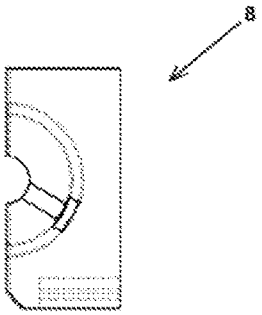
FIG. 33.—Profile view of the part making up the other half of the guide for the return of the lacing tape and the exit thereof, provided with a movement channel to the central plane.

1. Activation of the electronic system, verification of the operation of the motors in both directions 9-13 and presence sensors 14-19, staying in standby mode after the suitable verification process.
2. Loading the reel holder 27 with the binding cord.
3. The presence sensor located in the reel holder detects the availability of the binding cord and waits.
4. Opening the assembly in two halves in order to insert the cable bundle according to FIG. 34.
5. When a cable bundle is inserted on the inside, it is detected by the sensor to this end 19 and the assembly is automatically closed.
6. With the help of the motors 9-13, operating in the direction the introduction of the lacing tape through the inside of the eight parts 1-8 and the presence sensors 14-19, the corresponding complete penetration of the lacing tape is produced from the end thereof, forming the consecutive path of the two knots described, the clove hitch around the cable bundle followed by another safety knot on the former as shown in FIGS. 6-7.

Phase B—Movement of guide parts prior to the tightening of corresponding knots keeping the assembly in the closed position.

Figure 35:
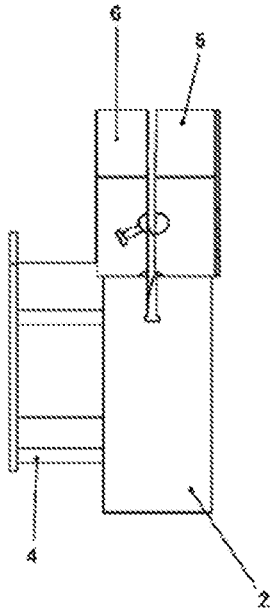
FIG. 35.—Main profile view of the eight guide parts making up the "Automated module for binding a cable bundle" in the position for removing the cable bundle with the aim of showing the two guide releasing movements in order to consecutively tense the lacing tape on the two knots thereof.

At this point, once the lacing tape has formed the complete path associated with the corresponding knots, the system automatically carries out the two respective movements according to FIG. 35 to release the lacing tape in each of the two knots, respectively;

7. The guide body for lacing tape 3-4 which traces the outline of the cable bundle is removed, according to longitudinal movement in the direction of the cable bundle.
8. Relative opening movement is carried out, which is also longitudinal to the cable bundle of the four parts 5-8 which stay above the cable bundle 26, in order for there to be a central channel which enables it, as the lacing tape is subsequently pulled upon forming the safety knot, to be able to exit the guide parts thereof, making use of that central channel.

PHASE C—Tightening the clove hitch knot keeping the assembly in the closed position.

9. Making use of the corresponding motors 11-13 turning in the direction wherein the aforementioned knot is tightened once the lacing tape does not find the guide bodies for the lacing tape 3-4 as it passes, and the knot is tensed around the cable bundle at the desired tension.

PHASE D—Tightening the double knot keeping the assembly in the closed position.

10. Once the previous knot is tensed, the double safety knot which stays above the former is then tensed by rotating the corresponding motors 10-12 in the direction wherein they pull and, therefore, tighten the corresponding lacing tape in a controlled manner, making it exit from the guide thereof in order to move to the central channel in the plane of which it has freedom of movement to carry out the tensing thereof around the previously-tightened clove hitch knot.

PHASE E—Cutting the lacing tape at both ends at a certain distance.

Figure 34:
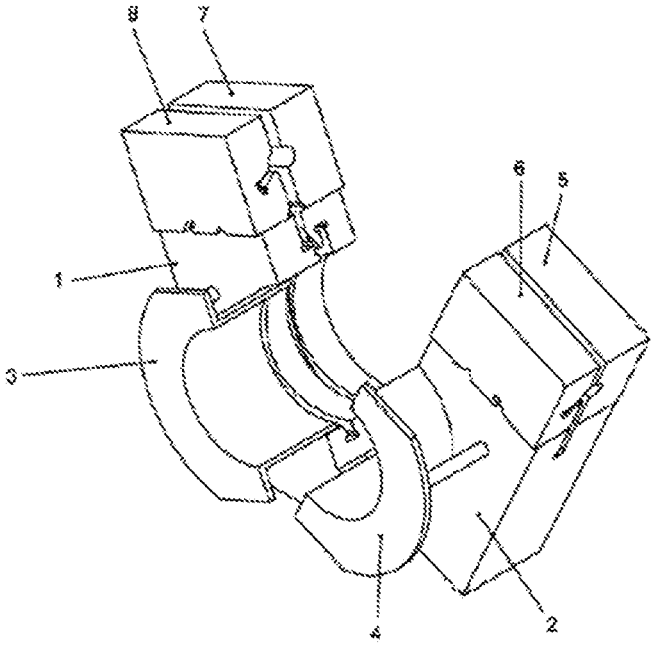
FIG. 34.—Main perspective view of the eight guide parts making up the "Automated module for binding a cable bundle" in the position for removing the cable bundle.

PHASE F—Opening the guide parts 1-8 in order to be able to remove the cable bundle 26 from the tied position thereof according to FIGS. 34-35.

It is not considered necessary to make this description more extensive so that any person skilled in the art may understand the scope of the invention and the advantages derived therefrom, the materials used, lacing tape pulling or presence detection technology, automation of the operation of the assembly, dimensions, opening system described to release guides, as well as the proposed geometric configuration, will be susceptible to variation as long as this does not imply an alteration in the essential nature of the invention.

The terms describing the specification must be understood in a broad and not-limiting manner.

The invention claimed is:

1. An automated module for binding a cable bundle carried out based on defining guides according to eight parts of the automated module being arranged in two halves, the automated module configured to open and close around the cable bundle, and a lacing tape configured to be pushed between the eight parts once the automated module is closed, the lacing tape entering the automated module, the lacing tape being guided through a first return and a second return, and the lacing tape forming, between the first return and the second return, a first knot around the cable bundle, the first knot being followed by a second knot on the first knot, before the lacing tape exits the automated module, wherein the automated module is configured to connect to a reel holder and corresponding motors for tightening the first knot and the second knot, and wherein the automated module is configured to bind the cable bundle based on the combination of the following main elements, according to two groups of elements with a first group of four solid elements that wrap around the cable bundle and make up the first knot, followed by a second group of four solid elements that stay above the cable bundle and make up the second knot, superimposed on the first group of four solid elements and provided with longitudinal movement with respect to the first group of four solid elements, the automated module comprising:

A. a first half of a main body configured to longitudinally wrap around the cable bundle;

B. a second half of the main body configured to longitudinally wrap around the cable bundle, the second half of the main body joined to the first half of the main body by a longitudinal shaft for opening the automated module and removing the cable bundle therefrom;

C. a first half of a guide body for lacing tape which traces an outline of the cable bundle, the first half of the guide body acting as an inner wrapping of the first half of the main body, the first half of the guide body configured to move longitudinally relative to the cable bundle;

D. a second half of the guide body for lacing tape which traces the outline of the cable bundle, the second half of the guide body acting as an inner wrapping of the second half of the main body, the second half of the guide body configured to move longitudinally relative to the cable bundle;

E. a first half of a guide for first introduction of the lacing tape and the second return thereof;

F. a second half of the guide for the first introduction of the lacing tape and the second return thereof, provided with a first movement channel to a central plane;

G. a first half of the guide for the first return of the lacing tape and a final exit thereof; and H. a second half of the guide for the first return of the lacing tape and the final exit thereof, provided with a second movement channel to the central plane.

2. A method for operating an automated module for binding a cable bundle, the automated module comprising eight solid elements that define a guide, the method comprising:

A. loading the automated module for binding a cable with a lacing tape making use of a reel holder;

B. opening the automated module for binding the cable bundle into two halves in order to introduce a cable bundle therein;

C. closing the automated module for binding the cable bundle after inserting the cable bundle therein;

D. penetrating the lacing tape from a first end of the automated module, forming a consecutive path of a first knot and a second knot, respectively, the first knot located around the cable bundle that is started once the lacing tape returns to the automated module through a second face opposite from a first face through which the lacing tape makes first access, followed by the second knot over the first knot, the second knot started after making a first return on the second face for accessing the automated module and exits the automated module through the second face opposite from a first entry;

E. once the lacing tape has formed a complete path associated with corresponding knots, a guide body for lacing tape which traces an outline of the cable bundle is removed, according to longitudinal movement in the direction of the cable bundle;

F. simultaneously to the previous step, a relative opening movement is carried out, that is also longitudinal to the cable bundle, of four solid elements of the automated module that stay above the cable bundle, in order for there to be a central channel which enables the relative opening movement, as the lacing tape is subsequently pulled upon forming the second knot, to be able to exit guides thereof, making use of the central channel;

G. tightening the first knot keeping the automated module in a closed position, making use of corresponding motors turning in a direction wherein the first knot is tightened once the lacing tape does not find one or more guide bodies for the lacing tape as it passes, and the first knot is tensed around the cable bundle at a desired tension;

H. tightening a second knot keeping the automated module in the closed position, once the first knot is tensioned, the second knot which stays above the first knot then tensed by rotating corresponding motors in a direction wherein they pull and, therefore, tighten the lacing tape in a controlled manner, causing the lacing tape to exit in two exits thereof from the automated module, from the guides thereof moved with respect to a central plane in order to be located over the central plane wherein the guides have freedom of movement to carry out the tensioning thereof around the first knot;

I. cutting the lacing tape at both ends at a certain distance; and

J. opening eight solid elements making up the guide to be able to take the cable bundle out of a tied position thereof.

3. The method of claim 2, wherein the first knot is a clove hitch knot.

4. The method of claim 2, wherein the second knot is a safety knot.

5. The method of claim 2, wherein the second knot is a double safety knot.

* * * * *